United States Patent [19]

Rowe et al.

[11] 4,208,045

[45] Jun. 17, 1980

[54] PRESSURE ASSEMBLIES

[75] Inventors: Howard Rowe; Paul A. Rowe, both of Kidlington, England

[73] Assignee: C.P.R. Engineering Developments Limited, Oxford, England

[21] Appl. No.: 22,644

[22] Filed: Mar. 21, 1979

[51] Int. Cl.[2] ..... B25B 1/08

[52] U.S. Cl. ..... 269/100; 254/104; 269/234; 269/241; 269/242

[58] Field of Search ..... 269/234, 321 A, 241, 269/242, 95, 100, 101; 254/104

[56] References Cited

U.S. PATENT DOCUMENTS

| | | | |
|---|---|---|---|
| 1,869,631 | 8/1932 | Swanson | 269/234 |
| 2,034,076 | 3/1936 | Zahner | 254/104 |
| 3,390,862 | 7/1968 | Schrepfer | 254/104 |
| 4,125,251 | 11/1978 | Jamieson | 269/321 A |
| 4,140,305 | 2/1979 | Rabin | 269/321 A |

*Primary Examiner*—Robert C. Watson
*Attorney, Agent, or Firm*—Larson, Taylor and Hinds

[57] ABSTRACT

A pressure assembly comprises a base plate, a ram and a wedge located between the base plate and the ram, the wedge having an inclined face facing the base plate or ram, the facing surface of the base plate or ram being inclined at the same angle and a screw adapted to move the wedge at right angles to the separation of the ram and base plate to alter the separation of the ram and base plate. Preferably a pair of wedges are provided, and preferably their inclined faces are oppositely-inclined. The pressure assembly may be used in conjunction with a support member adapted to be secured to a firm foundation, for example by bolts passing through bores. The assembly can be used to clamp a workpiece between the ram and a fixed member by engagement of the base plate with the fixed member and by increasing the separation of the ram from the base plate by rotating the screw.

10 Claims, 2 Drawing Figures

PRESSURE ASSEMBLIES

FIELD OF THE INVENTION

This invention relates to a pressure assembly comprising a base plate and a ram and means for moving the plate relative to the ram. In a screw clamp, the screw acts as the moving means and one turn of the screw causes the base plate and the ram to change their separation by the pitch of the screw. The pressure which can be exerted by the base plate and the ram is limited by the strength of the screw.

BRIEF SUMMARY OF THE INVENTION

This limitation is overcome by providing a screw which acts indirectly on the ram and the base plate through the medium of a wedge.

According to the invention, there is provided a pressure assembly comprising a base plate, a ram and a wedge located between the base plate and the ram, the wedge having an inclined face facing the base plate or the ram, the facing surface of the base plate or ram being inclined at the same angle and a screw adapted to move the wedge at right angles to the separation of the ram and base plate to alter the separation of the ram and base plate. In this arrangement, the screw acts indirectly on the base plate and the ram, through the medium of the wedge. The wedge can be provided with a large surface area to resist the forces between the ram and the base plate and the angle of the wedge can be selected to give a suitable multiplication factor between the axial movement of the screw relative to the base plate and the separation of the base plate from the ram.

Preferably the assembly comprises a pair of wedges having oppositely inclined faces arranged to be moved in opposite directions by said screw.

Preferably means are provided for securing the ram and the base plate to the wedge to prevent relative movement between the wedge on the one hand and the ram and base plate on the other hand in the direction of the separation of the ram and base plate.

The pressure assembly may be used in conjunction with a support member against which the base plate or the ram may be placed so that pressure may be exerted on a workpiece placed against the other of the base plate and ram on movement of the wedge in the pressure assembly.

DETAILED DESCRIPTION

Figure 1:
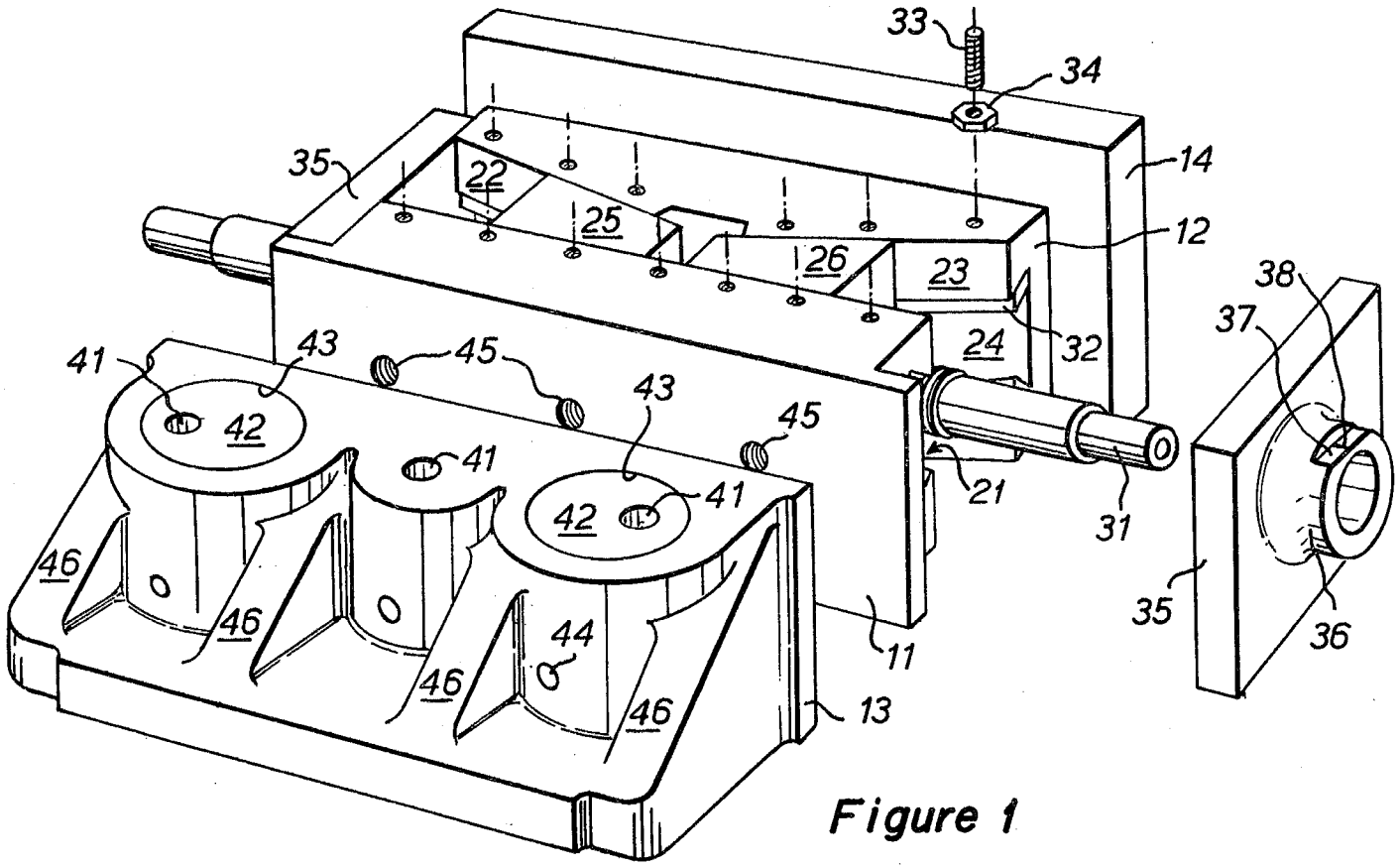
FIG. 1 is an isometric partially exploded view of an embodiment of the improved pressure assembly of the present invention.

The pressure assembly shown in FIG. 1 comprises a base plate 11 and a ram 12 having outwardly facing parallel surfaces whose separation can be adjusted. If fixed members 13 and 14 are provided with inwardly facing parallel surfaces, the pressure assembly can be placed for example with the surface of base plate 11 engaging the fixed member 13 and the separation between the base plate 11 and the ram 12 can be increased to clamp a workpiece between the surface of the ram 12 and the fixed member 14.

The base plate 11 is a parallel-sided member with a dovetail-shaped groove 21 on the side facing the ram 12. The ram 12 has a pair of inclined surfaces 22 and 23 arranged symmetrically facing the base plate 11 and each surface 22 and 23 has a dovetail-shaped groove 24 formed therein.

A pair of wedges 25 and 26 are arranged between the base plate 11 and the ram 12, the wedges having surfaces inclined at the same angle as the surfaces 22 and 23 and facing those surfaces. The wedges 25 and 26 have dovetail-shaped projections (not visible) on both sides for running in the grooves 21 and 24 so that the facing surfaces of the wedges with the base plate 11 and with the ram 12 are kept in engagement although the wedges can move at right angles to the separation of the base plate 11 from the ram 12.

Movement of the wedges 25 and 26 at right angles to the separation of the base plate 11 from the ram 12 is controlled by a shaft 31 provided with oppositely directed threaded portions passing through threaded bores in the wedges 25 and 26 so that rotation of the shaft 31 in one direction will cause the wedges to move towards each other and thus increase the separation of the base plate 11 from the ram 12 and rotation of the shaft 31 in the opposite direction will retract the ram 12 towards the base plate 11 through the action of the grooves 21 and 24 with the lugs on the wedges 25 and 26.

Along the upper edge of the dovetail-shaped grooves 21 and 24 there is provided a gib or bearing strip 32 which is secured by a number of adjusting screws 33 provided with locking nuts 34.

End plates 35 are provided at each end of the base plate 11 and formed with bearing housings 36 for supporting the shaft 31 for rotation. The ends of the ram 12 slide between the facing surfaces of the end plates 35. The housings 36 are provided with a flat portion 37 marked with an index mark for use with a vernier indicator, which indicates the separation of the ram 12 from the base plate 11 from the rotation of the shaft 31.

The fixed member 13 is provided by a support casting having three bores 41 to receive fixing bolts. The centre bore is formed directly in the casting, but the two outer bores are formed eccentrically in plugs 42 received in larger bores 43 in the casting. Locking screws may be screwed into threaded apertures 44 in the casting to secure the plugs 42 in their desired position. Rotation of the plugs in opposite directions will cause the member 13 to be inclined to the line of the fixing bolts, and movement of the plugs in the opposite directions allows the bolts to be arranged in a triangle. Base plate 11 is provided with threaded bores 45 for securing the base plate 11 to the fixed member 13.

The fixed member 13 may be secured in a conventional mode to the bed of a machine tool, which bed has an underside recess with slots extending from the bed face to the recess. The slots are dimensioned to receive the shanks of securing bolts which pass through the bores 41 and are enlarged at one end for insertion of the securing bolt heads. Securing nuts are screwed onto the ends of the bolts which protrude from the top of the bores 41 to hold the fixed member 13 securely on the bed of the machine tool. Fixed member 13 is cast with rearwardly extending webs 46 for strength.

The positioning of the ram 12 relative to the base plate 11 can be achieved in a variety of ways using the sliding wedges 25, 26. The inclined faces can be between the base plate 11 and the wedges instead of or as well as between the ram 12 and the wedges, as illustrated.

The illustrated arrangement of the wedges with their narrower ends facing each other puts the shaft 31 under tension when the wedge assembly is being expanded, but the reverse arrangement (with the wider ends of the wedges facing) may be used.

Figure 2:
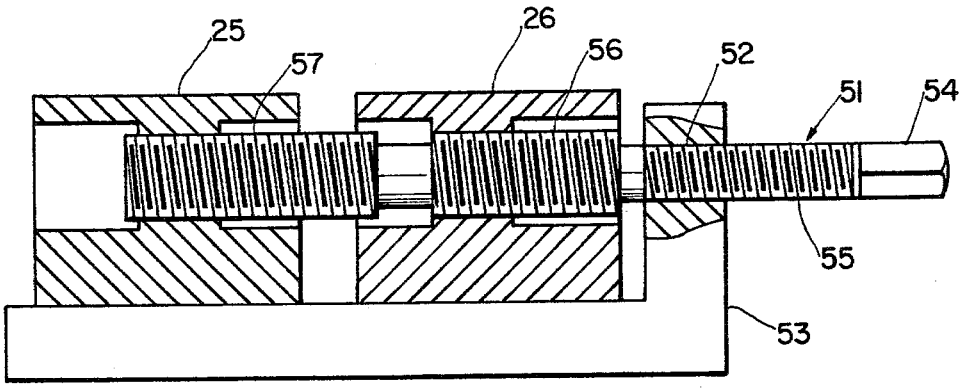
FIG. 2 is a cross-sectional view of an alternate embodiment of the adjusting shaft and wedges of the present invention.

In place of a shaft with oppositely-handed threads as discribed in the first embodiment, a shaft 51 having samehanded threads is shown in FIG. 2. Shaft 51 is mounted by and engages a threaded bore of a thrust bearing 52 in an end plate 53 which is secured rigidly to base plate 11 (not shown). At the end of shaft 51 near end plate 53, a square section 54 is formed to facilitate the turning of shaft 51 by a handle (not shown). Shaft 51 has three threaded portions 55, 56 and 57 all having the same sense but of different pitches. For example, threaded portion 55 has a 2.5 mm pitch, threaded portion 56 has a 2.0 mm pitch and threaded portion 57 has a 3.0 mm pitch. Threaded portions 56 and 57 engage, respectively, wedges 26 and 25. When shaft 51 is rotated one turn, for example in the direction to move square section 54 towards end plate 53, threaded sections 56 and 57 move 2.5 mm away from end plate 53. At the same time that threaded section 57 travels 2.5 mm, away from end plate 53, wedge 25 advances along shaft 51 in the opposite direction a distance of 2 mm for a net displacement of 0.5 mm towards end plate 53. Similarly, wedge 26 moves 2 mm along shaft 51 towards end plate 53 for a net displacement of 0.5 mm away from end plate 53. Therefore, the relative distance between wedges 25 and 26 has decreased 1 mm. In the same manner, when shaft 51 is rotated in the opposite direction, the relative distance between wedges 25 and 26 increases instead.

We claim:

1. A pressure assembly comprising a base plate, a ram, and a pair of wedges located between the base plate and the ram, the wedges having oppositely inclined faces facing the base plate or the ram, the facing surface of the base plate or ram being inclined at the same angle, a thrust bearing fixedly mounted relative to the base plate or the ram at one end thereof, and a screw supported in said thrust bearing for rotation and adapted to move the wedges symmetrically in opposite directions at right angles to the separation of the ram and base plate such that rotation of said screw alters the separation of the ram and base plate.

2. An assembly as claimed in claim 1 wherein said screw has portions of oppositely-directed threads for moving said wedges in opposite directions.

3. An assembly as claimed in claim 1 wherein said screw has three threaded portions of different pitches, the portion of intermediate pitch engaging a threaded bore in said thrust bearing and the other portions engaging respective wedges, the difference between the pitches being equal.

4. An assembly as claimed in claim 1 comprising means to secure the ram and the base plate to the wedges to prevent relative movement between the wedges on the one hand and the ram and the base plate on the other hand in the direction of the separation of the ram and base plate.

5. An assembly as claimed in claim 4 wherein said securing means comprises lugs and grooves which engage each other and which run longitudinally on said base plate, wedges and ram parallel to the axis of the screw.

6. An assembly as claimed in claim 5 wherein said lugs and grooves are dovetail-shaped.

7. An assembly as claimed in claim 5 wherein said grooves are provided with replaceable bearing plates along a surface engaging said lugs.

8. A clamping device comprising a support member adapted to be secured fixedly to a firm foundation and a pressure assembly as claimed in claim 1, said base plate being secured against a face of said support member.

9. A device as claimed in claim 8 wherein said support member is formed with fixing holes through which bolts may pass to secure the support member to a firm foundation, and means on said support member for adjusting the inclination of the line joining the fixing holes to said face of said support member.

10. A device as claimed in claim 9 wherein said support member is formed with three fixing holes, said inclination adjusting means being arranged to adjust two of the holes independently relative to the third so that the holes lie either in a single line of variable inclination to said face or at the corners of a triangle.

* * * * *